United States Patent [19]

Sami et al.

[11] 4,327,684

[45] May 4, 1982

[54] FUEL INJECTION AMOUNT - FLUID PRESSURE CONVERSION SYSTEM

[75] Inventors: Hiroshi Sami, Numazu; Tatehito Ueda, Susono, both of Japan

[73] Assignee: Toyota Jidosha Kogyo Kabushiki Kaisha, Aichi, Japan

[21] Appl. No.: 61,425

[22] Filed: Jul. 27, 1979

[30] Foreign Application Priority Data

Dec. 27, 1978 [JP] Japan ..... 53-182120[U]

[51] Int. Cl.[3] ..... F02D 1/12

[52] U.S. Cl. ..... 123/387; 123/385

[58] Field of Search ..... 123/387, 390, 378, 502, 123/385, 386

[56] References Cited

U.S. PATENT DOCUMENTS

| | | | |
|---|---|---|---|
| 2,253,455 | 8/1941 | Eideneier | 123/387 |
| 2,910,696 | 10/1959 | Heiser | 123/502 |
| 2,995,898 | 8/1961 | Thorner | 123/385 |
| 4,220,128 | 9/1980 | Kobayashi | 123/502 |

*Primary Examiner*—Charles J. Myhre
*Assistant Examiner*—Carl Stuart Miller
*Attorney, Agent, or Firm*—Birch, Stewart, Kolasch and Birch

[57] ABSTRACT

In an internal combustion engine equipped with a fuel injection pump which has a movable fuel amount determining element, the position of which determines the amount of fuel provided for injection by the fuel injection pump, a pressure regulating valve is disclosed which is coupled to the movement of the movable fuel amount determining element and which provides an output fluid pressure which represents the position of this element, and therefore represents the load on the engine. The valve comprises a fixed orifice supplied with a constant fluid pressure, a fluid passage downstream of the fixed orifice, a pressure takeoff passage branching from the fluid passage, and a variable orifice downstream of the fluid passage whose effective opening area is varied according to the movement of the fuel amount determining element. Fluid flows from the upstream side of the fixed orifice through it, through the fluid passage, and through the variable orifice, in that order, the pressure of fluid at the point where the pressure takeoff passage branches from the fluid passage varying according to the position of the fuel amount determining element.

7 Claims, 6 Drawing Figures

MOVEMENT OF MOVABLE FUEL AMOUNT DETERMINING ELEMENT (AMOUNT OF FUEL INJECTION)

MOVEMENT OF MOVABLE FUEL AMOUNT DETERMINING ELEMENT =MOVEMENT OF SPILL RING (AMOUNT OF FUEL INJECTION)

FUEL INJECTION AMOUNT - FLUID PRESSURE CONVERSION SYSTEM

BACKGROUND OF THE INVENTION

The present invention relates to the combination of a fuel injection pump and a conversion device which converts mechanical movement into fluid pressure, in an internal combustion engine.

More particularly, the present invention relates to the combination of a fuel injection pump which has a movable fuel amount determining element with a conversion device which converts mechanical movement of this fuel amount determining element into fluid pressure. Thus a fluid pressure may be obtained which corresponds to the position of the fuel amount determining element, and this may represent the load on the engine.

For controlling various mechanisms on a present-day internal combustion engine, it is useful to have a quantity available which represents the load on the engine in some way. For instance, such a quantity can be used for the control of an EGR valve. Now, in the case of a gasoline engine, wherein the speed regulator is the inlet throttle valve which controls the amount of intake mixture, engine power output or load is largely affected by the engine intake amount. Therefore, if the engine revolution rate and the opening of the inlet throttle valve are measured, the percentage of the load to full power capacity, or "engine load ratio," can be approximately determined.

It is also possible, in an engine having an inlet throttle valve as the speed regulator, to determine the engine load ratio from the inlet manifold vacuum. For example, in an engine equipped with an electronic fuel injection system, there are some arrangements in which the inlet manifold vacuum is measured, and the fuel injection amount is controlled as based thereon.

In the case of diesel engines, however, because they are constructed differently from gasoline engines, there are not many elements reflecting the load which are available in order to determine the engine load ratio. In order, therefore, to determine this engine load ratio it becomes necessary to measure the rate of fuel consumption directly. However, this measurement in itself is difficult, and requires relatively expensive equipment, and therefore is not suitable for application to use in ordinary motor vehicles.

Further, ways are known conventionally to determine the engine load ratio from the position of the accelerator pedal, or from the position of the fuel injection pump lever. This kind of method can be implemented easily, but errors in manufacture in the governing mechanism or in the accelerator pedal linkage affect the accuracy of sensing of these amounts. Therefore, high precision determination of these quantities is not possible in this way. Also, particularly with an ordinary fuel injection pump, the provision of a governing mechanism means that the fuel injection amount is not directly proportional to the position of the control lever, so that it is not possible to determine positively the engine load ratio from the position of the control lever alone.

SUMMARY OF THE INVENTION

Therefore, it is the object of the present invention to provide a device to provide a value representative of engine load, which is simple and positive in action and accurately determines the load ratio, in an internal combustion engine which is equipped with a fuel injection pump which has a movable fuel amount determining element.

It is a further object of the present invention to provide such a device which provides this value as a fluid pressure. By this, the signal can be accurately conveyed by a cheap mechanism to where it is required, such as at a device which is remote from the fuel injection pump itself, without distortion of its value.

In many fuel injection pumps the amount of fuel which is injected into the cylinders is controlled by the movement of such a movable fuel amount determining element. For example, in an inline fuel injection pump the fuel injection amount is adjusted by the movement of a control rack, and in a rotary or distributor-type fuel pump the fuel injection amount is adjusted by the movement of a so-called spill ring. Therefore, by providing a pressure control valve closely coupled to the movement of such a movable fuel amount determining element, and by controlling a fluid pressure with this pressure control valve, a fluid pressure can be obtained which is related to the fuel injection amount, i.e., in other words, is related to the engine load ratio.

Although the movement of the movable fuel amount determining element is relatively small, because the pressure control valve can be directly coupled to the movable fuel amount determining element itself, and because the movement required for the valve element of the pressure control valve is also relatively small, high accuracy in this coupling is possible, and a very good degree of correlation between the actual fuel injection amount provided by the fuel injection pump and the fluid pressure provided as an output by the pressure control valve can be provided, and thereby a high accuracy of conversion between engine load and fluid pressure can be obtained.

According to the present invention, therefore, this and other objects are accomplished, in an internal combustion engine, by the combination of a fuel injection pump which comprises a movable fuel amount determining element, the position of which regulates the amount of fuel provided for injection by the fuel injection pump, and a conversion device, comprising: a fixed orifice, to the upstream side of which is supplied a substantially constant fluid pressure; a fluid passage downstream of the fixed orifice; a pressure takeoff passage branching from the fluid passage; and a variable orifice downstream of the fluid passage whose effective opening area is varied according to the movement of the fuel amount determining element; fluid flowing from the upstream side of the fixed orifice through it, through the fluid passage, and through the variable orifice, in that order, the pressure of fluid at the point where the pressure takeoff passage branches from the fluid passage varying according to the position of the fuel amount determining element.

BRIEF DESCRIPTION OF THE DRAWINGS

The present invention will become more clear when considered in the light of the following description of several embodiments of the present invention, and the accompanying drawings. It should be clearly understood, however, that the description of these embodiments, and the drawings, are all given only for the purposes of illustration and explanation, and are not to be taken as in any way intended to limit the scope of the present invention, or of the protection sought to be afforded. In the drawings.

DESCRIPTION OF THE PREFERRED EMBODIMENTS

Figure 1:
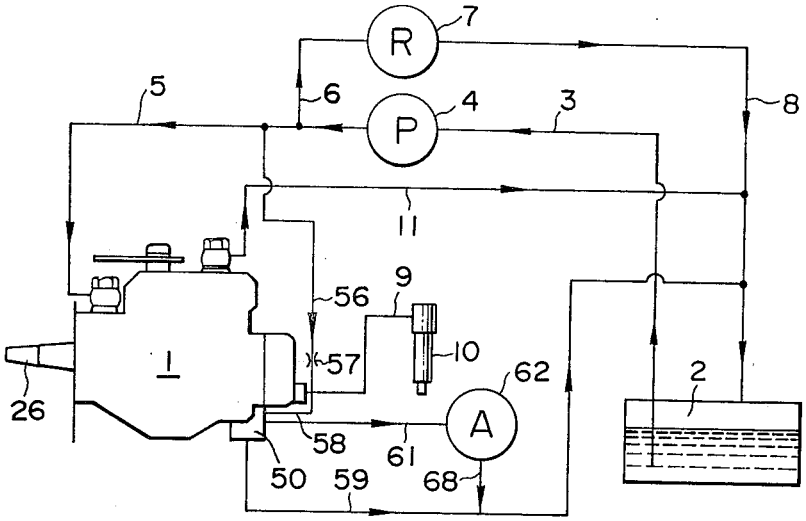
FIG. 1 is a rather schematic diagram showing the fuel supply system of a diesel internal combustion engine equipped with an injection pump, and a converter device, according to the present invention.
Figure 2:
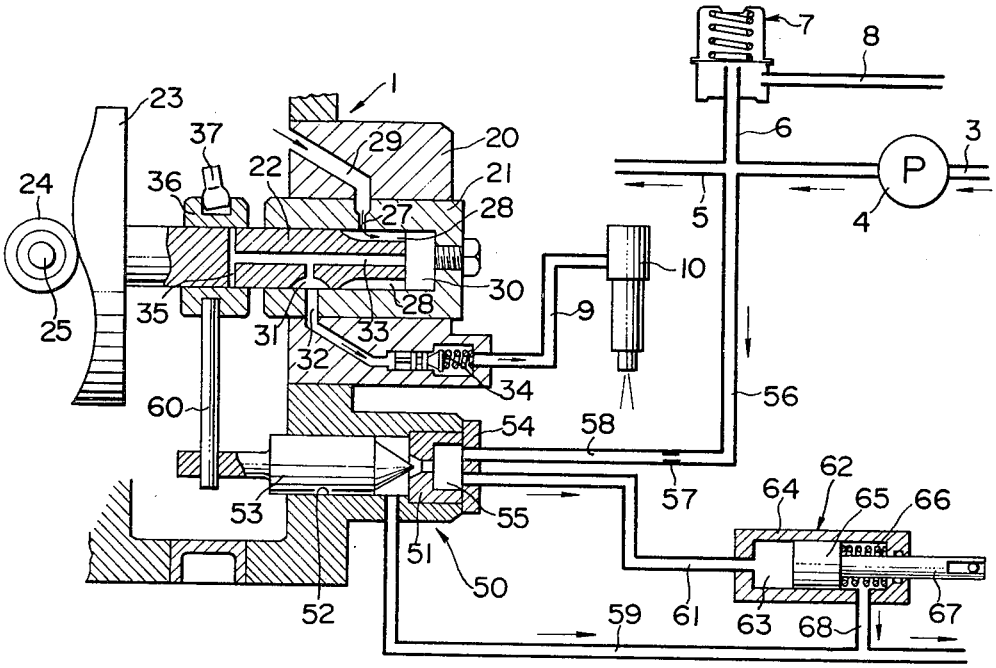
FIG. 2 is a vertical cross section showing the essential parts of the fuel injection pump of the engine in FIG. 1, and of the converter device, according to the present invention, and also showing a pressure reaction type actuator which is activated by the pressure supplied by the converter.

Referring now to FIGS. 1 and 2, there is shown a first embodiment of the present invention. FIG. 1 shows the basic layout of the fuel circulation and supply system of a diesel internal combustion engine, and FIG. 2 is a somewhat schematic vertical cross section of the main parts of this engine which are relevant to the understanding of the present invention. Reference numeral 1 designates a distributing type fuel injection pump, to which fuel is supplied from the fuel tank 2 through a first pipe 3, a supply fuel pump 4, and a second pipe 5. A part of the fuel flowing through the second pipe 5 is returned to the fuel tank 2 through the first fuel return pipe 6, the pressure regulator 7, and the second fuel return pipe 8. Thus, in practice, the fuel pressure within the second pipe 5 is maintained at a substantially constant value.

The fuel injection pump 1 takes in fuel through the second pipe 5 and delivers the appropriate amount of fuel required for driving the engine from moment to moment through the injector pipes 9 to the fuel injectors 10. From the fuel injectors 10 this fuel is injected into the combustion chambers of the engine, or alternatively into auxiliary combustion chambers of the engine which are not shown in the figure. Although in the figure only one injector pipe 9 and one fuel injector 10 are shown, in fact the engine may have a plurality thereof, typically four or six of each. Surplus fuel taken in by the fuel pump 1, over and above the needs of the engine at any particular time, is returned to the fuel tank 2 through a third fuel return pipe 11.

As is better shown in FIG. 2, this distributor type fuel injection pump 1 is provided with a sealed construction housing 20, within which liquid fuel is constantly supplied by the supply fuel pump 4 through the second pipe 5 so that the interior of the fuel injection pump 1 is filled up. Fixed within the fuel injection pump housing 20 is a plunger housing sleeve 21, and within this plunger housing sleeve 21 is received a pump plunger 22, which is movable along its axis, so that it may reciprocate from left to right and back again in the drawing, and which is also rotatable about its axis. This pump plunger 22 is formed integrally with a cam plate 23 of generally circular form, which is on the left hand end, in the figure, of the pump plunger 22. The cam plate 23 and pump plunger 22 are urged leftward in the figure by a spring means which is not shown in the drawings. The cam plate 23 bears against a roller 24, which is free to rotate about an axle 25, which is fixed to the pump housing 20 so as not to be movable with respect to this pump housing 20. The cam plate 23 is coupled to and is driven by a drive shaft 26 (which may be better seen in FIG. 1) which rotates at the same revolution speed as the engine, or at half this revolution speed, depending on whether the diesel internal combustion engine in question is a two stroke cycle or a four stroke cycle internal combustion engine. Therefore, as this cam plate 23 turns on the axis of the pump plunger 22, by the action of the spring means, and, by the rolling of the cam plate 23 on the roller 24 and the axle 25, the pump plunger 22 is reciprocated to and fro, in the left and the right directions in the figure, as it rotates.

As the pump plunger 22 moves from the right to the left and back again in the figure, the inlet port 27 in the plunger housing sleeve 21 comes into alignment with one of a plurality of inlet grooves 28 which are cut into the side of the pump plunger 22, and which run generally along the axial direction of its surface. Fuel, therefore, which fills the pump housing 20, is drawn through the connecting hole 29 and the inlet port 27, and comes into the pump chamber 30, which is at the right hand end in the figure of the pump plunger 22, via the inlet groove 28.

Then, as the pump plunger 22 continues its reciprocating rotation, the inlet port 27 is closed by the edge of the inlet groove 28 traversing it, and next the distribution port 31 of the pump plunger 22 comes into alignment with one of a plurality of distribution passages 32 which are formed in the plunger housing sleeve 21. This distribution port 31 is connected, via a short radial passage which has no reference number in the drawing, with an axial passage 33 which is bored along the axis of the pump plunger 22, and which communicates with the pump chamber 30. It should be noted that there is provided only one inlet port 27, and there are provided a plurality of inlet grooves 28, one for each injector to be supplied with fuel; whereas, on the other hand, there are provided a plurality of distribution passages 32, one for each injector to be supplied with fuel, but there is provided only one distribution port 31. Thus fuel distribution is performed for each cylinder by directing fuel injection to its injector at the appropriate time, by the rotation of the pump plunger 22.

Next, the pump plunger starts to move to the right in the drawing, and thereby pressure is put on the fluid in the pump chamber 30. This fuel can no longer escape through the groove 28 and the inlet port 27, because, as stated above, these are now closed. Therefore it is driven into the axial passage 33, through the short radial passage, and, via the distribution port 31, into the distribution passage 32, through the delivery valve 34, (which is a one way valve intended to stop any reverse flow of fuel into the fuel pump, to stop the ingress of air thereinto, and to make the application of a certain positive pressure necessary for supply of fuel to the injectors), into the injector pipe 9, and via this to the fuel injector 10.

The pump plunger continues this rightwards movement in the diagram, pumping fuel into the delivery passage 32 and to the fuel injector 10, until the spill port 35 moves out of the spill ring 36, which is closely fitted around the outside of the pump plunger 22 where it projects leftwards in the figure from the plunger housing sleeve 21. As seen in the figure, this spill port 35 is a transverse passage bored radially through the pump plunger 22 at the end of the axial passage 33 and communicating therewith. When this spill port 35 is uncovered by the spill ring 36, the pump chamber 30 is connected, via the axial passage 33 and the spill port 35, with the inside of the pump housing 20, and the fuel under pressure in the pump chamber 30 and the axial passage 33 is able to escape to the inside of the pump housing 20 via the spill port 35, and is therefore no longer at high pressure, but at the relatively low pressure which is present in the pump housing 20. Thereby, pumping of fuel to the fuel injectors immediately ceases, by the action of the valve 34, as well as by the action of one way valves in the injectors themselves.

This spill ring 36 is moved to and fro, to the right and the left in the diagram, by a lever 37. This lever 37 may be coupled to the accelerator of the vehicle, through a governing device of a well known type which is not shown in the figure, so that, in response to increased load on the engine, the spill ring 36 is moved in the rightwards direction in the figure, and, in response to decreased load on the engine, the spill ring 36 is moved in the leftwards direction in the figure. It will be seen that the amount of fuel injected by the above described fuel injection pump 1 is determined by the position of the spill ring 36. In other words, if the spill ring 36 is moved to a certain amount in the leftwards direction in the diagram, the interval during a single reciprocating stroke of the pump plunger 22 during which the spill port 35 is open and is uncovered by the spill ring 36 is longer, and therefore the effective stroke of the pump is shorter, and hence the amount of fuel delivered is less. On the other hand, if the spill ring 36 is moved to a certain amount in the rightwards direction in the diagram, the interval during a single reciprocating stroke of the pump plunger 22 during which the spill port 35 is open and is uncovered by the spill ring 36 is shorter, and therefore the effective stroke of the pump ls longer, and hence the amount of fuel delivered is greater.

Thus the spill ring 36 may be termed a movable fuel amount determining element.

The above described construction of a fuel pump is not per se novel. However, in this fuel pump, which contains a movable fuel amount determining element, there is provided a conversion device, according to the present invention, generally designated at 50, which provides a fluid pressure corresponding to the movement of this spill ring or movable fuel amount determining element 36. Thereby a fluid pressure is available which corresponds closely to the amount of fuel injected into the cylinders of the engine moment by moment, and this pressure thus corresponds to the load on the engine. As has been outlined above, this pressure can be advantageously employed for a range of purposes, and in FIG. 2 it is illustrated as employed to actuate a pressure reaction type actuator 62.

The conversion device 50 comprises a valve seat element 51 fixed to the pump housing 20, and a needle element 52 which is supported so as to move to and fro along its axis, left and right in the drawing, within a supporting bore 52 which is formed in the pump housing 20. The valve seat element 51 and the needle element 53 co-operate, as seen in the drawing, to form a variable orifice, whose effective opening area is thus determined by the relative positions of the needle element 53 and the valve seat element 51. The needle element 53 is linked by a coupling rod 60 to the spill ring 36, and moves left and right therewith, thus determining the effective opening area of the orifice which it forms in co-operation with the valve seat element 51. In this embodiment, as the needle element 53 moves to the right in the diagram, the effective orifice area is diminished.

Together with a cover plate 54, the valve seat element 51 defines a pressure adjustment chamber 55. Two pipes 58 and 61 lead to this pressure adjustment chamber 55. The fuel pipe 58 leads, via a fixed metering orifice element 57, to the supply pipe 56, which joins to the second pipe 5 at an intermediate position thereof which contains fuel supplied by the supply fuel pump 4, as has been mentioned above, at a substantially constant pressure, and is supplied with fuel therefrom. The pressure takeoff pipe 61 is used for monitoring or taking off the pressure in the pressure adjustment chamber 55, and no substantial ongoing flow occurs therein.

Thus, fuel supplied at a substantially constant pressure by the pump 4 flows through the supply pipe 56, through the fixed metering orifice element 57, through the pipe 58, into the pressure adjustment chamber 55, past the variable orifice formed between the valve seat element 51 and the point of the needle element 53, and into the inside of the supporting bore 52, from which it is drained, via a drain pipe 59, back to the fuel tank 2, as shown in FIG. 1.

It will be easily seen by those skilled in the hydraulic art that, as the fluid fuel flows along this path from the substantially constant source of fluid pressure as at 4, the fluid pressure within the pressure control chamber 55 will be raised and lowered, depending upon the position of the needle element 52 with respect to the valve seat element 51, and therefore according to the position of the spill ring 36. Therefore this pressure will represent the load on the engine.

In this embodiment, purely by way of illustration, this pressure is used to operate a pressure reaction type actuator 62. The pressure takeoff pipe 61 leading from the pressure adjustment chamber 55 provides the abovementioned fluid pressure, which corresponds to the load on the engine, to the pressure chamber 63, which is formed within the housing 64 of the pressure reaction type actuator 62. Reciprocating within this housing 64 is a piston 65, which is driven to the right in the diagram by the pressure in the pressure chamber 63, and is biased to the left in the diagram by the biasing force of the compression coil spring 66 and by any residual fluid pressure that may exist in the tank return passage 59, which is led to the other side of the piston 65 by a passage 68 which also serves to drain any fuel that may leak past the piston 65. Thus to a certain extent any back pressure in the fuel return system is cancelled out. It will be seen that the piston 65 is moved rightwards in the figure by an amount which corresponds to the amount of movement of the spill ring 36, i.e. to the amount of fuel currently being injected into the engine, i.e. the current load on the engine. And, as will easily be appreciated, the pressure takeoff pipe 61 may be long and tortuous, and the pressure reaction type actuator 62 may be in quite another part of the automobile from the fuel injection pump 1, without in any way reducing the accuracy of the amount of the motion of the piston 65, as corresponding to the load on the engine. The piston 65 is coupled to one end of a piston rod 67, which may be used for activating some device.

Figure 3:
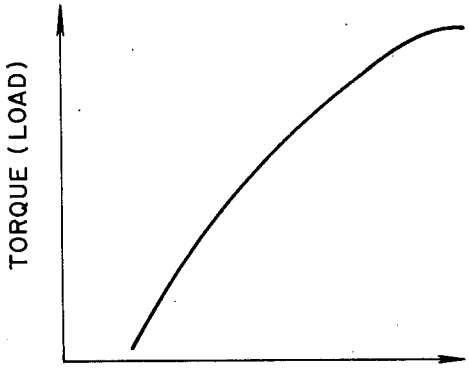
FIG. 3 is a graph showing the relationship between the engine torque and the position of the fuel amount measuring element for the fuel injection pump, in the engine of FIGS. 1 and 2.

Now, as is shown in FIG. 3, the shaft torque of a diesel engine is more or less proportional to the amount of displacement of its movable fuel amount determining element, or, in other words, to the amount of fuel delivered to the cylinders of the engine. That is, because the efficiency of the engine varies depending on changes in the load, the fuel injection amount is not perfectly proportional to the torque on the crankshaft, but is approximately so. Thus, when the load is high, the spill ring 36 of the fuel injection pump 1 will be shifted to the right in the diagram, and because the fuel injection amount is thereby increased the engine torque will increase. At this time the needle element 53 is also shifted to the right in the figure, along with the rightward movement of the spill ring 36, and thus the effective orifice area of the variable orifice formed between the right hand end of the needle element 53 and the valve seat element 51 is decreased. For this reason, the flow resistance of this variable orifice will increase, and accordingly the amount of outflow of fuel from the pressure adjustment chamber 55 to the tank return passage 59 decreases, and at the same time the pressure within the pressure adjustment chamber 55 increases. This pressure is communicated, via the pressure takeoff pipe 61, to the actuator 62.

Figure 4:
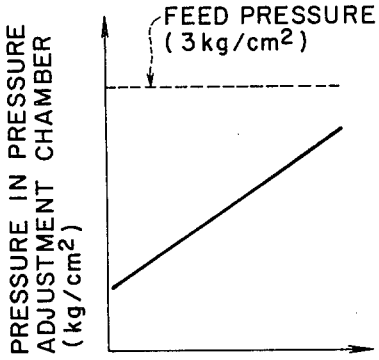
FIG. 4 is a graph showing the relationship between the pressure in the pressure control chamber and the position of the fuel amount determining element.

Conversely, when the engine load decreases, the spill ring 36 moves to the left in the diagram, and accordingly together with it the needle element 53 also moves to the left. Therefore, the effective area of the variable orifice increases, its flow resistance decreases, and the amount of outflow of fuel from the pressure adjustment chamber 55 correspondingly increases, thus lowering the pressure within the pressure adjustment chamber 55. This lower pressure is fed to the actuator 62 through the pressure takeoff pipe 61. Thus, as may be seen from FIG. 4, the pressure within the pressure adjustment chamber 55 rises in response to an increase in the load, and drops in response to a decrease in the load, and thus within the pressure adjustment chamber 55 is generated a fluid pressure representing the engine load.

Accordingly, the actuator 62 is operated in accordance with the loading of the engine.

Figure 5:
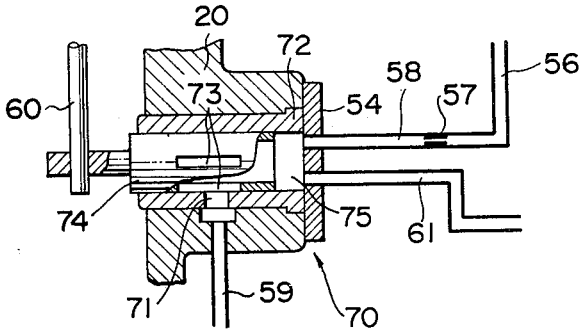
FIG. 5 is a fragmentary vertical cross section through another embodiment of the variable orifice device as used in the present invention.

FIG. 5 is a partial section through a further embodiment of the present invention, and shows a variable orifice device as used in the present invention which is of another type. The portions in FIG. 5 which correspond to similar portions in FIGS. 1 and 2 are designated by the same reference numerals. This conversion device 70, which converts motion of a fuel amount determining element in the fuel injection pump to a fluid pressure, comprises a liner element 72 which is fixed to the pump housing 20 (which is similar to the one in the previously described embodiment of FIGS. 1 and 2), and this liner element 72 has a port 71 and a piston element 74 which is inserted within the liner element 72 so as to be slidably movable along its axis. Further, the piston element 74 is provided with a slit 73 which matches with the port 71. Thus the slit 73 and the port 71 together form a variable orifice. The piston element 74 is coupled to the spill ring 36, as shown in FIG. 1, by a coupling rod 60, and is moved to and fro left and right in the figure corresponding to the movement of this spill ring 36. Thus, in this case also, the effective orifice area of this variable orifice is also changed according to the motion to and fro left and right in the figure of the piston element 74, and therefore it is seen that in this variable orifice device according to the present invention, also, a fluid pressure is generated which is related to engine load, in the adjustment pressure chamber 75, which is to the right of the cup element 74.

In the drawing, it will be seen that the slit 73 is in fact provided as a set of slits arranged at different points around the circumference of the hollow cylindrical piston element 74. Although it is not explicitly so shown in the figure, the port 71 is likewise provided as a set of plural ports arranged around the circumference of the liner element 72, so that each of these ports 71 corresponds to one of the slits 73. Further, all these ports 71 are communicated with one another by a passage groove which is cut around the circumference of the wall of the cylindrical hole in the pump housing 20 which receives the liner element 72, which can be seen in section just above the upper end of the pipe 59 in the drawing. Thereby a good anti-blocking characteristic is provided for the variable orifice device.

Further, it will be observed that in the drawing the ports 71 are shown as being somewhat smaller in axial length than the slits 73, and that the illustrated position of the piston element 74 is such that the ports 71 are fully uncovered by the slits 73 so as to provide the maximum possible opening area to the variable orifice device. Further, it will be observed that in fact the piston element 74 of the variable orifice device, in the drawing, has in fact moved considerably to the right past the first position during its movement to the right at which the ports 71 are fully uncovered by the slits 73, so that the latter portion of this rightwards motion has had no substantial effect on the amount of effective opening area provided by the variable orifice device. This is in accordance with another particular feature of the present invention.

In more detail, when the load on the engine is maximum, and thus the amount of fuel provided by the fuel injection pump is maximum, the spill ring 36 is to its extreme position to the right (see FIG. 1), and therefore in FIG. 5 the piston element 74 is far to the right, and the ports 71 are completely out of register with the slits 73, and accordingly no fluid flow at all exists in the supply pipe 56, fixed orifice 57, pipe 58, adjustment pressure chamber 75, and drain pipe 59. Therefore, the pressure supplied to the pressure takeoff pipe 61 and to the actuator 62 is maximal. Now, as the load on the engine gradually decreases, the spill ring 36 moves leftwards, whereby the piston element 74 is moved leftwards in FIG. 5, and accordingly the left hand ends of the slits 73 cooperate with the right hand ends of the ports 71 so as to provide a steadily increasing orifice area. Thus, the fluid flow through the supply pipe 56, fixed orifice 57, pipe 58, adjustment pressure chamber 75, slits 73, ports 71, and drain pipe 59 increases steadily, and correspondingly a steadily decreasing pressure is present in the pressure adjustment chamber 75, and is supplied via the pressure takeoff pipe 61 to the actuator 62. However, the left hand ends of the slits 73 pass the left hand ends of the ports 71 before the spill ring 36 has reached the position which provides minimum or idling fuel injection performance of the fuel injection pump 1. In fact this point is reached when a certain predetermined amount of fuel is still being delivered by the fuel injection pump 1, and thereafter, as the spill ring 36 is moved further leftwards (in FIG. 1), and the delivery amount of the fuel injection pump continues to decrease, the opening area of the variable orifice provided by the conversion device 70 is again decreased to zero, and so the pressure provided to the actuator 62, to summarize, increases to the maximum. This particular performance of pressure variation is effective for the control of an EGR valve.

Figure 6:
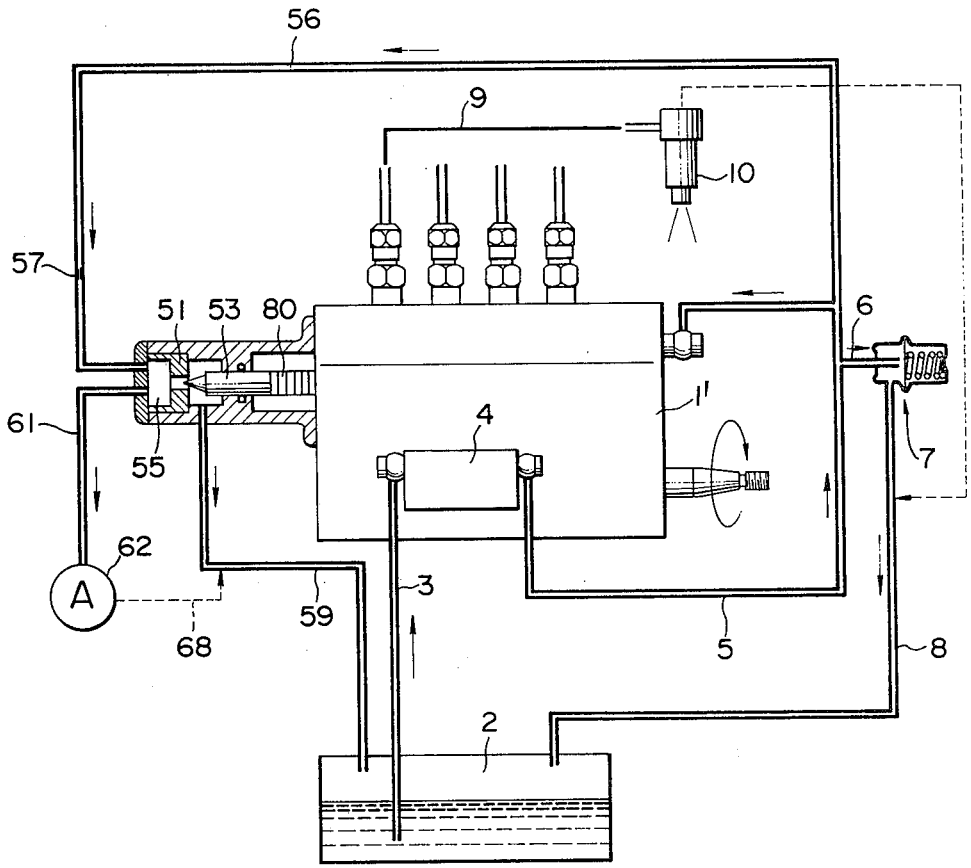
FIG. 6 is a simplified diagram, in partial vertical cross section, of another embodiment of the present invention, wherein the fuel pump of the diesel internal combustion engine is a series type or in-line type fuel injection pump.

FIG. 6 is a schematic diagram, again partly cut away, showing an embodiment of the present invention in which a load-fluid pressure device is incorporated in a fuel injection system which uses a fuel injection pump which is of the in-line or serial type. In FIG. 6, also, portions which correspond to similar portions in the figures illustrating the previous two embodiments are designated by the same reference numerals. In the case of this fuel injection pump 1', of the in-line type, the adjustment of the amount of fuel delivered is made by a control rack 80. This control rack 80 is, in this embodiment, formed integrally with a needle element 53, which is part of a variable orifice device 50, at its one end. As the control rack 80 moves to the left in the diagram, the fuel injection amount is increased, and at the same time, with this leftwards movement in the diagram of the control rack 80, the effective orifice area of the variable orifice, which is determined by the separation between the needle element 53 and the valve seat element 51, is decreased. Therefore, in this embodiment also, a fluid pressure is generated in the adjustment pressure chamber 55 which is related to the engine load, in the same manner as in the previous embodiments. It will be noted that in this embodiment, because of the particular construction of an in-line type fuel injection pump, it is very practicable to form the needle element 53 on the end of the control rack as one unit, and thereby accuracy of metering of the passage area of the orifice between the needle element 53 and the valve seat element 51 is increased, since no link or coupling rod such as 60 in the other embodiments described is required.

As will be clear from the above description of several preferred embodiments, according to the present invention, by using a variable orifice device whose effective opening area is altered according to the movement of a movable fuel amount determining element of the fuel injection pump, a fluid pressure can be obtained which corresponds to the engine load. Further, since in the present invention conversion is made directly from the movement of the fuel amount determining element to the fluid pressure by a simple and robust hydraulic device, the response of the system is good, and its construction is simple.

Although the present invention has been shown and described in terms of several preferred embodiments thereof, it should be clearly understood that various changes and omissions in the form and content of any particular embodiment of the invention may be made therein, without departing from its scope or spirit. Therefore, it is expressly desired that the scope of the present invention, and of the monopoly sought to be granted by Letters Patent, should be determined, not by any details of the embodiments described or of the purely illustrative drawings, but solely by the appended claims.

We claim:

1. In an internal combustion engine, a device which is the combination of:

a distributor type fuel injection pump which comprises a spill ring as a movable fuel amount determining element, the position of which regulates the amount of fuel provided for injection by the fuel injection pump;

and a conversion device, comprising:

a fixed orifice, to the upstream side of which is supplied a substantially constant fluid pressure;

a fluid passage downstream of the fixed orifice;

a pressure takeoff passage branching from the fluid passage;

a variable orifice downstream of the fluid passage comprising a valve seat and a needle element with a pointed end which cooperates with the valve seat so as to provide a passage of variable effective area, according to the axial movement of the needle element, and wherein the effective opening area of said variable orifice is varied according to the movement of the fuel amount determining element; and a connecting rod which links the needle element to the spill ring, whereby fluid flows from the upstream side of the fixed orifice through it, through the fluid passage, and through the variable orifice, in that order, and the pressure of fluid at the point where the pressure takeoff passage branches from the fluid passage varies according to the position of the fuel amount determining element.

2. A combination device as in claim 1, wherein the fuel injection pump is an in-line type fuel pump, and the movable fuel amount determining element is a control rack, and wherein the needle element is abutted directly to the end of the control rack.

3. A combination device as in claim 2, wherein the needle element is formed as one piece integrally with the control rack.

4. In an internal combustion engine, a device which is the combination of:

a fuel injection pump which comprises a movable fuel amount determining element, the position of which regulates the amount of fuel provided for injection by the fuel injection pump;

and a conversion device, comprising:

a fixed orifice, to the upstream side of which is supplied a substantially constant fluid pressure;

a fluid passage downstream of the fixed orifice;

a pressure takeoff passage branching from the fluid passage;

a variable orifice downstream of the fluid passage whose effective opening area is varied according to the movement of the fuel amount determining element, whereby fluid flows from the upstream side of the fixed orifice through it, through the fluid passage, and through the variable orifice, in that order, and the pressure of fluid at the point where the pressure takeoff passage branches from the fluid passage varies according to the position of the fuel amount determining element; and the mode of variation of the effective area of the opening of the variable orifice is such that said opening area increases as pump delivery amount is increased up to a first predetermined amount, remains substantially constant as pump delivery amount is thereafter increased up to a second predetermined amount, and progressively decreases as pump delivery amount is thereafter increased.

5. A combination device as in claim 4, wherein the variable orifice comprises a cylindrical sleeve and a hollow piston slidingly reciprocating in the sleeve, the sleeve being formed with a port in its cylindrical surface, and the piston being formed with a hole through it which corresponds to the port, so that as the piston reciprocates in the sleeve the cooperation of the hole and the port provides a variable orifice, fluid flowing between the inside of the piston and the port.

6. A combination device as in claim 5, wherein the piston is formed with a plurality of holes and the sleeve is formed with the same number of ports, each of which corresponds with one of the holes, said ports also communicating with one another.

7. A combination device as in claim 5 or 6, wherein the piston is reciprocated in the sleeve according to the movement of the movable fuel amount determining element, and wherein: as the movable fuel amount determining element is moved in the direction to decrease the pump delivery amount, from its position wherein the pump is delivering its maximum delivery amount, the piston is moved in the sleeve so as progressively to bring the holes and ports into register, until a certain first point when the holes and ports are so in register as to provide their maximum possible mutual fluid passage opening area; thereafter, as the movable fuel amount determining element moves further in the direction to decrease the pump delivery amount until it reaches a certain second position, the piston is further moved in its sleeve, but the holes and ports move while in mutual register so as not substantially to alter their mutual fluid passage opening area; and thereafter, as the movable fuel amount determining element moves further in the direction to decrease the pump delivery amount past the second position, the piston is further moved in its sleeve so that the holes and ports are progressively brought out of register.

* * * * *